United States Patent [19]

Abe et al.

[11] Patent Number: 4,773,016

[45] Date of Patent: Sep. 20, 1988

[54] LEARNING CONTROL SYSTEM AND METHOD FOR CONTROLLING AN AUTOMOTIVE ENGINE

[75] Inventors: Kunihiro Abe, Higashimurayama; Yoshitake Matsumura, Hachiouji; Takurou Morozumi, Mitaka, all of Japan

[73] Assignee: Fuji Jukogyo Kabushiki Kaisha, Tokyo, Japan

[21] Appl. No.: 753,842

[22] Filed: Jul. 11, 1985

[30] Foreign Application Priority Data

Jul. 17, 1984 [JP] Japan ..... 59-148998

[51] Int. Cl.[4] ..... F02D 41/24; F02D 41/26; F02M 25/06

[52] U.S. Cl. ..... 364/431.06; 123/440; 123/486; 364/431.05

[58] Field of Search ..... 123/440, 480, 486; 364/431.05, 431.06

[56] References Cited

U.S. PATENT DOCUMENTS

| | | | |
|---|---|---|---|
| 4,309,971 | 1/1982 | Chiesa et al. | 123/480 |
| 4,348,727 | 9/1982 | Kobayashi et al. | 364/431.06 |
| 4,348,728 | 9/1982 | Sagisaka et al. | 364/431.06 |
| 4,365,299 | 12/1982 | Kondo et al. | 364/431.06 |
| 4,373,187 | 2/1983 | Ishii et al. | 364/431.06 |
| 4,430,976 | 2/1984 | Kondo et al. | 123/440 |
| 4,432,331 | 2/1984 | Yasuhara | 364/431.06 X |
| 4,571,683 | 2/1986 | Kobayashi et al. | 364/431.06 |
| 4,594,667 | 6/1986 | Yasuhara | 364/431.06 |

*Primary Examiner*—Felix D. Gruber
*Attorney, Agent, or Firm*—Martin A. Farber

[57] ABSTRACT

Two matrixes, each of which is formed by two variables of engine operation such as engine load and engine speed, is provided in staggered relation on the X axis by a predetermined value. Two tables are provided, each having addresses corresponding to the X axis of the matrix. Data stored in the two tables is updated when a single position in at least one of the matrixes remains the same for a predetermined time. Data in the two tables are read out and available data is calculated from the two data.

14 Claims, 7 Drawing Sheets

FIG. 4a
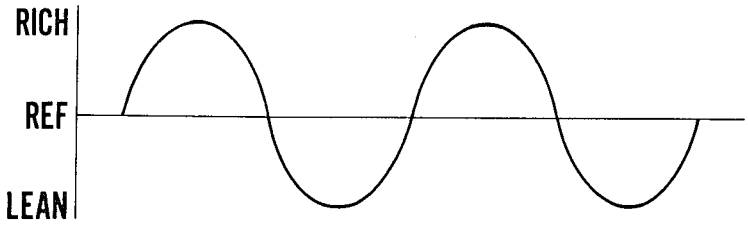
FIG. 4b
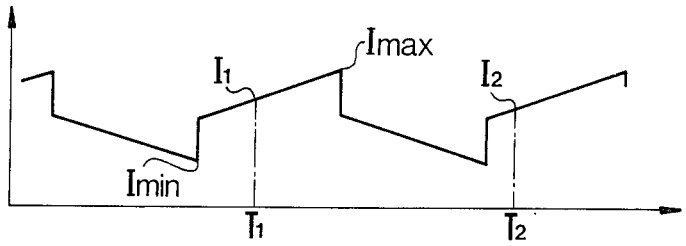
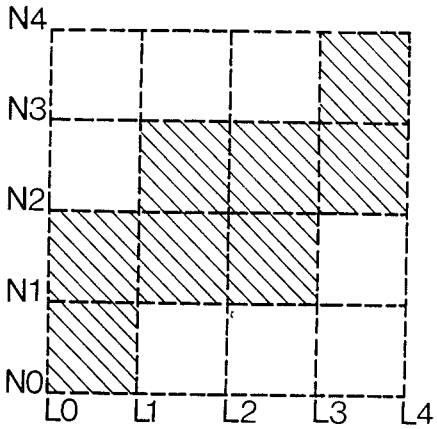
FIG. 6a
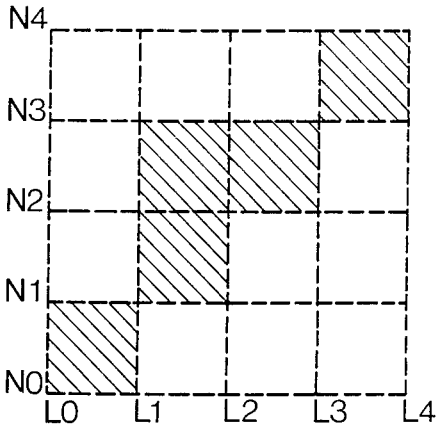
FIG. 6b

LEARNING CONTROL SYSTEM AND METHOD FOR CONTROLLING AN AUTOMOTIVE ENGINE

BACKGROUND OF THE INVENTION

The present invention relates to a method and system for controlling the operation of an automotive engine, and more particularly to a learning control system for updating data stored in a table for the learning control.

In a learning control system, updating of data is performed with new data obtained during the steady state of engine operation. Accordingly, means for determining whether the engine operation is in the steady state is necessary. A conventional learning control system (for example Japanese Patent Application Laid Open No. 56-165744 corresponding to U.S. Pat. No. 4,309,971) has a matrix (two-dimensional lattice) comprising a plurality of divisions, each representing engine operating variables such as engine speed and engine load. When the variables continue for a predetermined period of time in one of the divisions, it is determined that the engine is in the steady state. On the other hand, a three-dimensional look-up table is provided in which a matrix coincides with the matrix for determining the steady state. Data in the look-up table is updated with new data obtained during steady state.

In such a system, if the engine operating variables fluctuate in two adjascent two divisions over the border line between both divisions without staying in one of the divisions during the predetermined period of time, the system can not determine such a state as a steady state, although such a state should be determined as a steady state. Accordingly, data corresponding to both adjacent divisions are not updated, which delays the correction of data and reduces the frequency of the learning. This means that the motor vehicle is driven by fuel having an improper air-fuel ratio, which increase fuel consumption and reduces driveability.

SUMMARY OF THE INVENTION

The object of the present invention is to provide a system which can detect engine operating conditions at portions near border lines of a matrix for the detection of steady state of engine operation.

According to the present invention, there is provided a system for controlling an automotive engine by updated data used for controlling the operation of the engine, comprising first means for determining that engine operation is in steady state in accordance with first and second matrixes formed by two variables of engine operation and for producing output signals.

The first and second matrixes are staggered on one of X and Y axes by a predetermined value. The system further comprises second means for providing new data for updating in accordance with engine operating conditions, first and second tables, each having addresses dependent on one of the two variables, and third means for updating data stored in the tables with the new data in response to the output signals of the first means at corresponding addresses.

The other objects and features of this invention will become understood from the following description with reference to the accompanying drawings.

BRIEF DESCRIPTION OF DRAWINGS

FIG. 4*a* shows the output voltage of an $O_2$-sensor;

FIG. 4*b* shows the output voltage of an integrator;

FIGS. 6*a* and 6*b* are illustration for explaining probability of updating.

DETAILED DESCRIPTION OF THE PREFERRED EMBODIMENT

Figure 1:
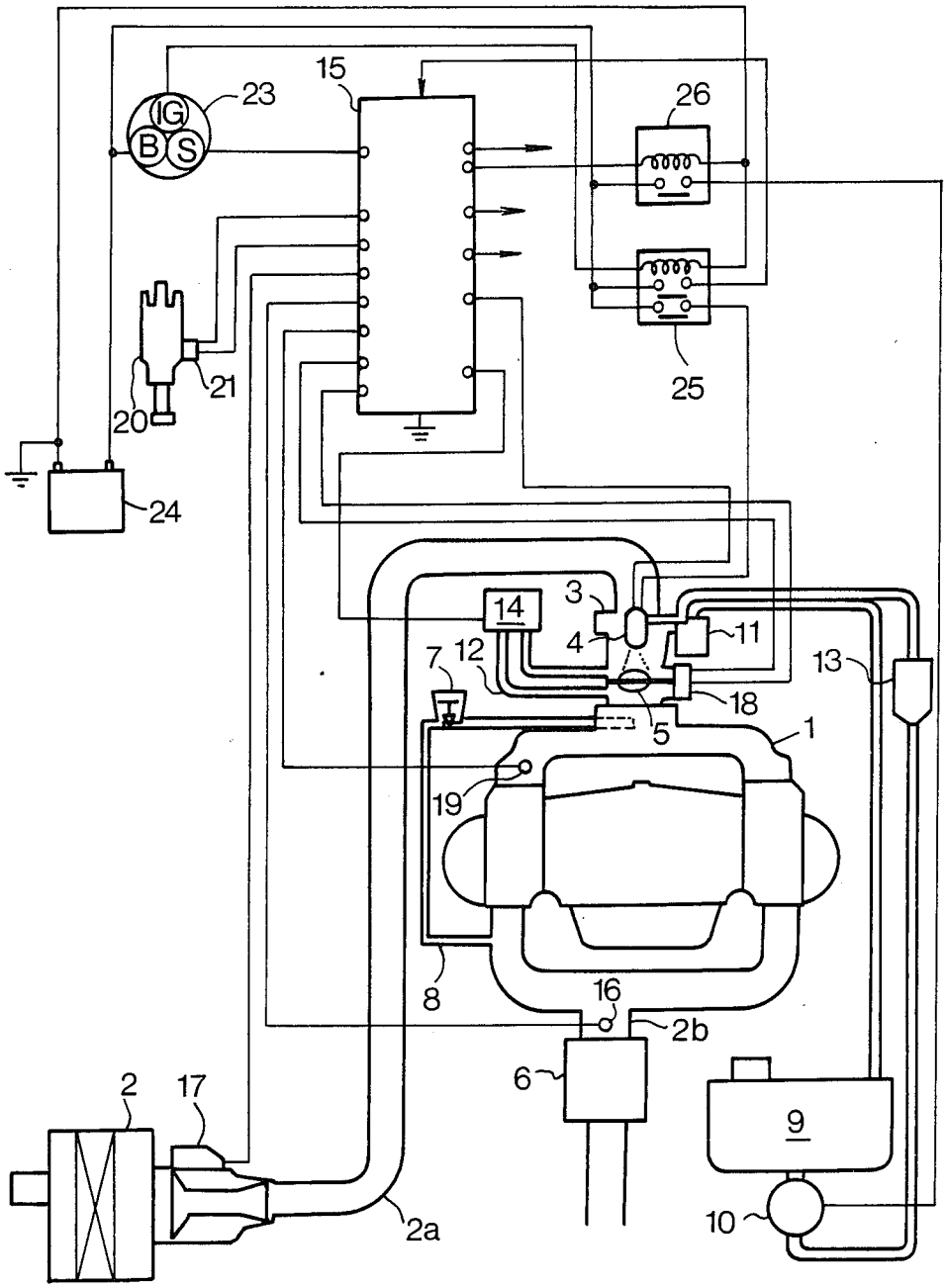
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, an intake pipe 2*a*, and a throttle valve 5 in a throttle body 3, mixing with fuel injected from an injector 4. A three-way catalitic converter 6 and an $O_2$-sensor 16 are provided in an exhaust passage 2*b*. An exhaust gas recirculation (EGR) valve 7 is provided in an EGR passage 8 in a well-known manner.

Fuel in a fuel tank 9 is supplied to the injector 4 by a fuel pump 10 through a filter 13 and pressure regulator 11. A solenoid-operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn electric current from a battery 24 on and off. The system is further provided with an injector relay 25 and a fuel pump relay 26 for operating the injector 4 and fuel pump 10.

Figure 2:
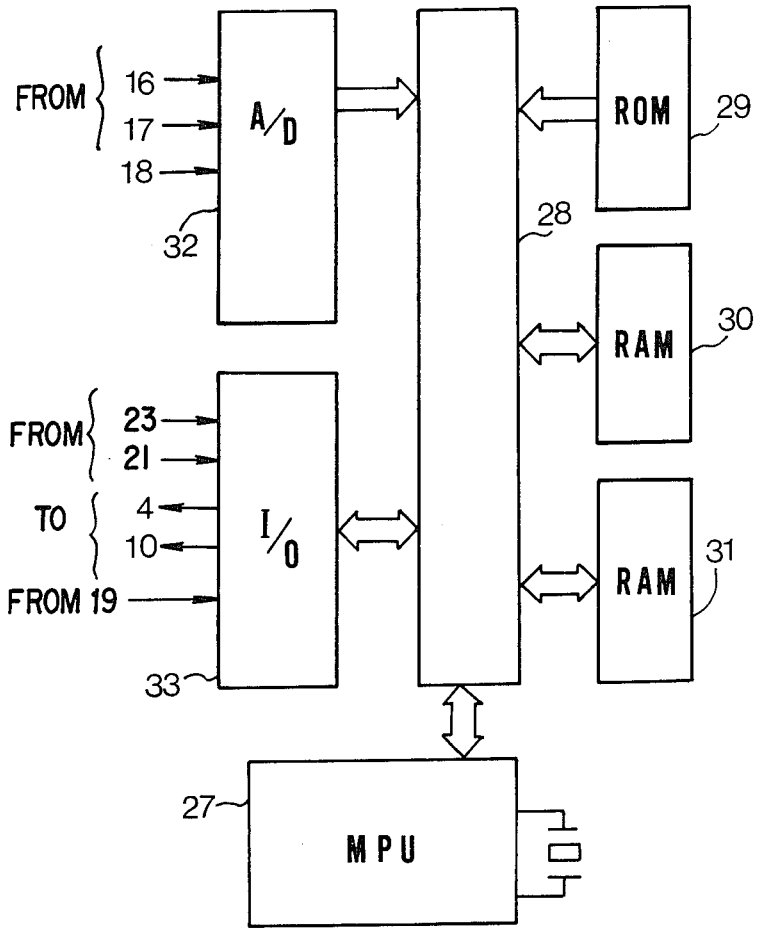
FIG. 2 is a block diagram of a microcomputer system used in a system of the present invention.

Referring to FIG. 2, the microcomputer 15 comprises a microprocessor unit 27, ROM 29, RAM 30, RAM 31 with back-up, A/D converter 32 and I/O interface 33. Output signals of the $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates the input signals and executes the hereinafter described process. In one type of electronic fuel-injection control, for example Japanese Laid Open Patent Application No. 57-122135, the amount of fuel to be injected by the injector 4 is determined in accordance with engine operating variables such as mass air flow, engine speed and engine load. The amount of fuel is determined by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (COEF) \times \alpha \times K_a \quad (2)$$

where COEF is a coefficient obtained by adding various correction or compensation coefficients such as coefficients of coolant temperature, full throttle open, engine load, etc., $\alpha$ is a $\lambda$ correcting coefficient (the integral of the feedback signal of the $O_2$-sensor 16), and $K_a$ is a correcting coefficient by learning (hereinafter called the learning control coefficient). Coefficients, such as the coolant temperature coefficient and engine load, are obtained by looking them up in tables in accordwith sensed information. The learning control coefficients $K_a$ stored in a $K_a$-table are updated with data calculated during the steady state of engine operation. In a conventional system, the steady state is recognized by ranges of engine load and engine speed in a single matrix and continuation of a detected state in one of the divisions in the matrix.

Figure 3A:
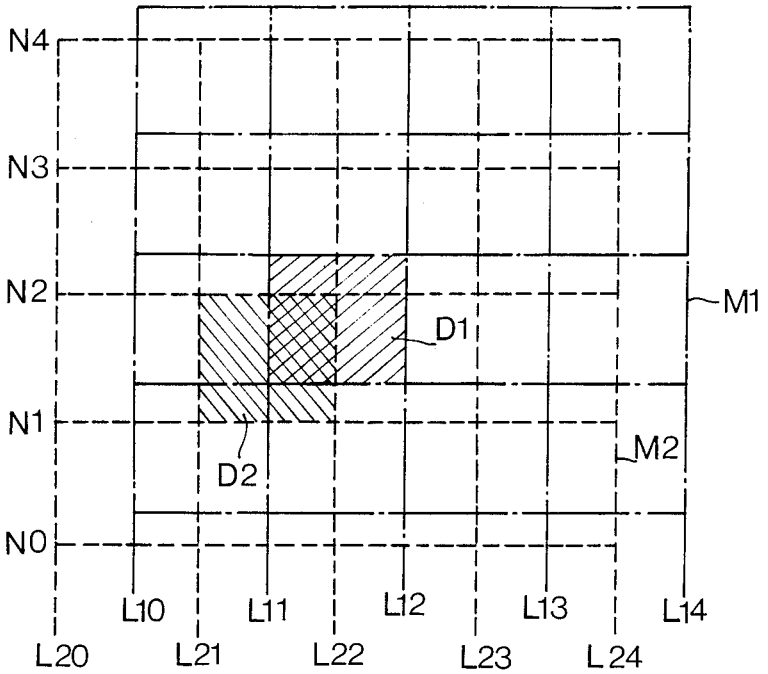
FIG. 3*a* is an illustration showing matrixes for detecting steady state of engine operation.

In accordance with the present invention, two matrixes are employed. FIG. 3*a* shows the two matrixes $M_1$ and $M_2$. The X axis of each matrix represents engine load and the Y axis represents engine speed. Both matrixes are staggered on the X axis by a suitable value of engine load, and each matrix comprises, for example sixteen divisions defined by five row lines (X axis) and five column lines (Y axis). Magnitudes of engine load are set at five points $L_{10}$ to $L_{14}$ and $L_{20}$ to $L_{24}$ on the X axes, and magnitudes of engine speed are set at five points $N_0$ to $N_4$ for matrix $M_1$ and five points for matrix $M_2$ on the Y axes. Thus, the engine load in each matrix is divided into four ranges, for example $L_{10}$–$L_{11}$, $L_{11}$–$L_{12}$, $L_{12}$–$L_{13}$, and $L_{13}$–$L_{14}$. Similarly, the engine speed is divided into four ranges.

On the other hand, the output voltage of the $O_2$-sensor 16 cyclically changes through a reference voltage corresponding to a stoichiometric air-fuel ratio, as shown in FIG. 4*a*. Namely, the voltage changes between high and low voltages corresponding to rich and lean air-fuel mixtures. In the system, when the output voltage (feedback signal) of the $O_2$-sensor continues during three cycles within one of the sixteen divisions in each matrix, the engine is assumed to be in steady state.

Figure 3B:
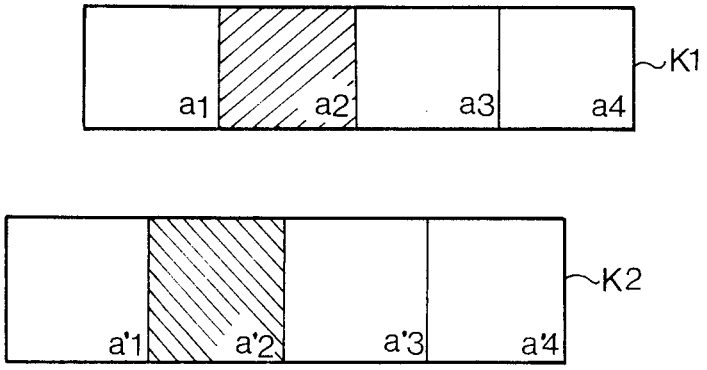
FIG. 3*b* shows tables for learning control coefficients.

FIG. 3*b* shows $K_a$-tables $K_1$ and $K_2$ for storing the learning control coefficients $K_a$, which are included in the RAM 31 of FIG. 2. The $K_a$-tables are two-dimensional tables, respectively, and have addresses $a_1$, $a_2$, $a_3$, and $a_4$, and $a'_1$ to $a'_4$, which correspond to the engine load ranges of FIG. 3*a*. For example, address $a_1$ corresponds to engine load range $L_{10}$–$L_{11}$ and address $a'_2$ corresponds to engine load range $L_{21}$–$L_{22}$. All of the coefficients $K_a$ stored in the $K_a$-table are initially set to the same value, that is the numerical value "1". This is caused by the fact that the fuel supply system is to be designed to provide the most proper amount of fuel without the coefficient $K_a$. However, every automobile can not be manufactured to have a desired function resulting in the same results. Accordingly, the coefficient $K_a$ should be updated by experience for every automobile, when it is actually used.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as the value of the correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, the integral of the output voltage of the $O_2$-sensor at a predetermined time is provided as the value of $\alpha$. More particularly, the computer has a function of an integrator, so that the output voltage of the $O_2$-sensor is integrated. FIG. 4*b* shows the output of the integrator. The system provides values of the integration at a predetermined interval (40 ms). For example, in FIG. 4*b*, integrals $I_1$, $I_2$—at times $T_1$, $T_2$—are provided. Accordingly, the amount of fuel is controlled in accordance with the feedback signal from the $O_2$-sensor, which is represented by an integral.

Explaining the learning operation, when the steady state of egine operation is detected, at least one of the $K_a$-tables is updated with a value relative to the feedback signal from the $O_2$-sensor. The first updating is done with an arithmetical average (A) of maximum value and minimum value in one cycle of the integration, for example values of Imax and Imin of FIG. 4*b*. Thereafter, when the value of $\alpha$ is not 1, the $K_a$-table is incremented or decremented with a minimum value ($\Delta A$) which can be obtained in the computer. Namely one bit is added to or subtracted from a BCD code representing the value A of the coefficient $K_a$ which has been rewritten at the first learning.

Figure 7A:
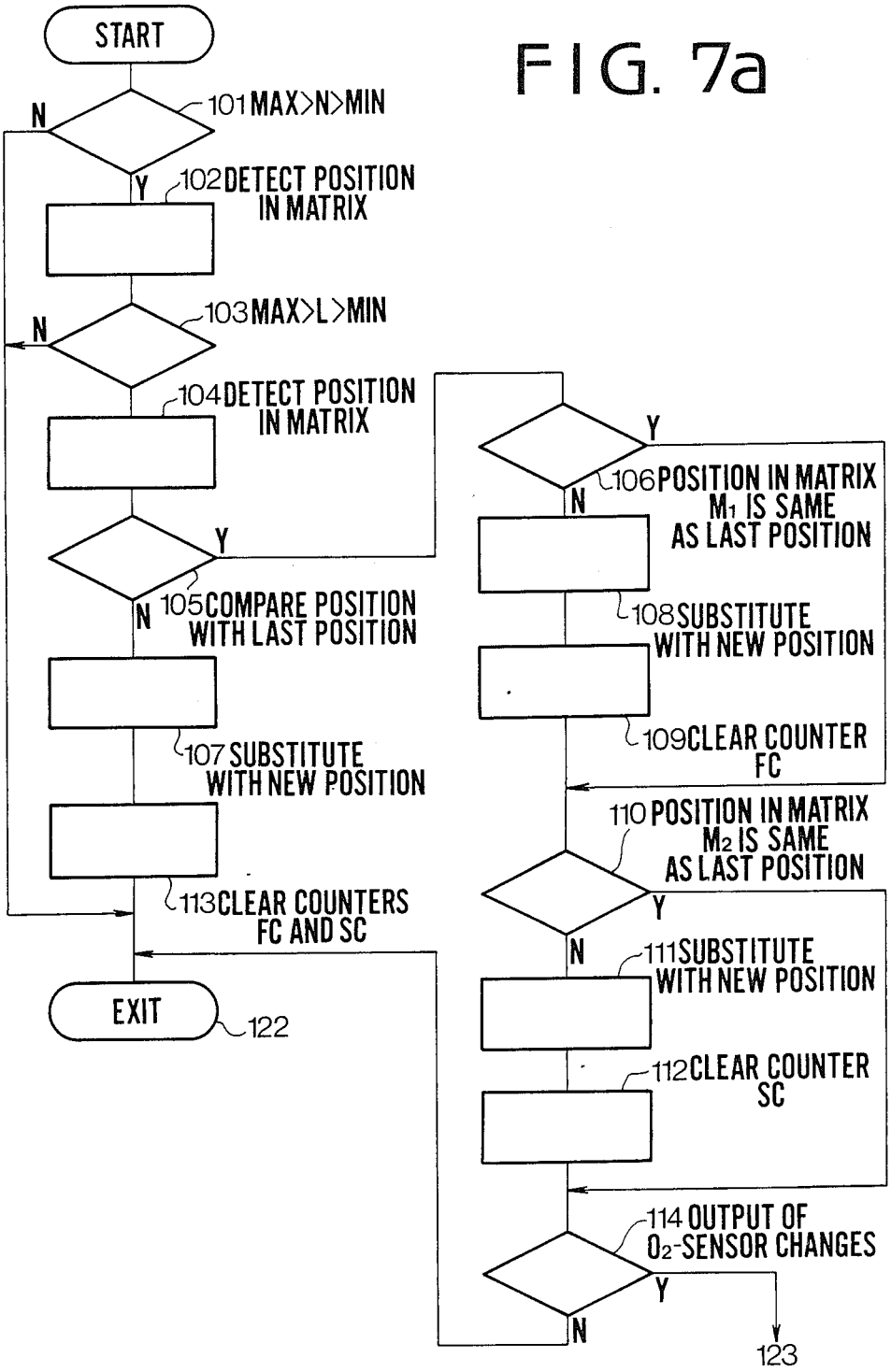
FIGS. 7*a* and 7*b* are flowcharts showing the operation in an embodiment of the present invention.
Figure 7B:
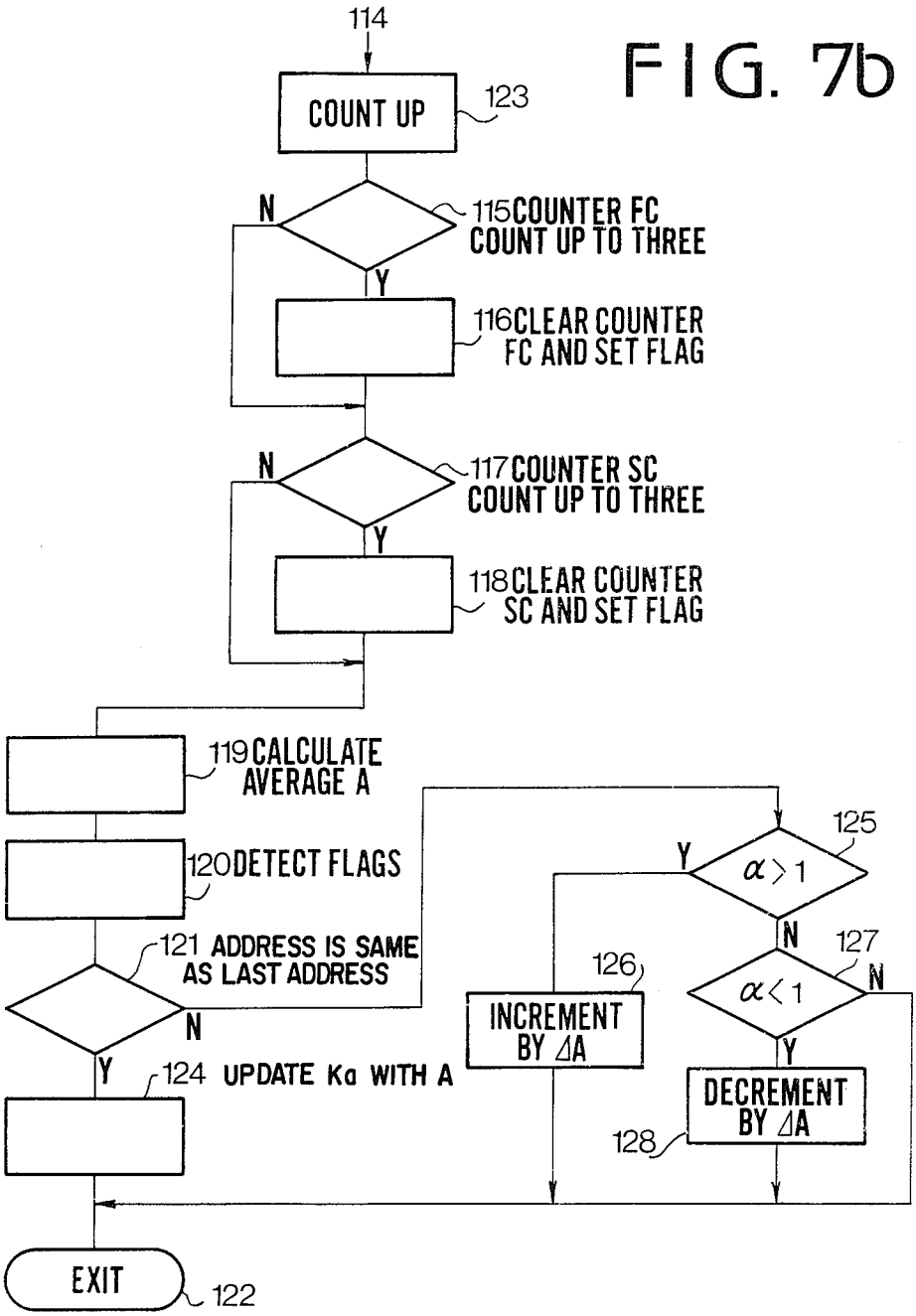

The operation of the system will be described in more detail with reference to FIGS. 7*a* and 7*b*. The learning program is started at a predetermined interval (40 ms). Upon the first operation of the engine and the first time the motor vehicle is driven, engine speed is detected at step 101. If the engine speed is within the range between $N_0$ and $N_4$, the program proceeds to a step 102. If the engine speed is out of the range, the program exits the routine at a step 122. At step 102, the position of the row of the matrix of FIG. 3*a* in which the detected engine speed is included is detected and the position is stored in the RAM 30. Thereafter, the program proceeds to a step 103, where engine load is detected. If the engine load is within the range of matrixes $M_1$ and $M_2$, the program proceeds to a step 104. If the engine load is out of the range, the program exits the routine. Thereafter, the position of the column corresponding to the detected engine load is detected in the matrixes, and the positions are stored in the RAM 30. Thus, positions $M_1(N,L)$, $M_2(N,L)$ corresponding to the engine operating condition represented by engine speed and engine load are determined in the matrixes, for example, divisions $D_1$ and $D_2$ are determined in FIG. 3*a*. The program advances to a step 105, where the determined divisions are compared with the divisions which were to have been detected at the last learning. However, since the present learning is the first, the comparison can not be performed, and hence the program is terminated passing through steps 107 and 113. At the step 107, the positions of the divisions are stored in the RAM 30.

At the next learning after the then first learning, detected positions are compared with the last stored positions of the divisions at step 105. If either of the positions $M_1(N,L)$, $M_2(N,L)$, in the matrixes is the same as the position at the last learning, the program proceeds to a step 106.

On the other hand, if both positions of the divisions are not the same as the last learning, the program proceeds to step 107, where the old data of the positions are substituted with the new data. At step 106, if the position $M_1(N,L)$ is the same as the last one, the program proceeds to a step 110, and if not, the program proceeds to a step 108, where the old data is substituted with the new data, and then the counter FC is cleared at the step 109. At step 110; if the position $M_2(N,L)$ is the same as the last one, the program proceeds to a step 114, and if not the program proceeds to a step 111, where the old data is substituted with the new data, and then the counter SC is cleared at the step 112. At the step 114, the output voltage of the $O_2$-sensor 16 is detected in both positions. If the voltage changes from rich to lean and vice versa, the program goes to a step 123, and if not, the program is terminated. At the step 123, the numbers of the cycles of the output voltage at both positions are counted up by a first counter FC and a second counter SC. If the first counter FC counts up to, for example three, the program proceeds to a step 116 from a step 115. If the count does not reach three, the program proceeds to a step 117. At the step 116, the counter FC is cleared and a flag for the corresponding address is set, and the program proceeds to step 117. At step 117, it is determined whether the second counter SC counts up to three. If the counter SC counts up to three, the program proceeds to a step 118, where the counter SC is cleared and a flag for the corresponding address is set, and the program advances to a step 119. If the counter does not count three, the program proceeds from step 117 to step 119.

On the other hand, at step 113, the counts registered in counters FC and SC at the last program are erased. At step 109, the counter FC is reset, and at step 112, the counter SC is reset.

At step 119, an arithmetical average A of the maximum and minimum values of the integral of the output voltage of the $O_2$-sensor at the third time of the output waveform is calculated and the value A is stored in the RAM 30. Thereafter, the program proceeds to a step 120, where the addresses by the flags set at steps 116 and 118 are detected. At a step 121, the address flags are compared with the last stored address flags. Before the address flags are set, the program proceeds to a step 124. At a step 124, the learning control coefficient $K_a$ in the addresses of the $K_a$-tables $K_1$ and $K_2$ of FIG. 3*b* are entirely updated with the new value A, that is the arithmetical average obtained at step 119.

At a learning after the first updating, if the address of one of the $K_a$-tables is the same as the last address, (the flag exists in the address) the program proceeds from step 121 to a step 125, where it is determined whether the value of $\alpha$, (the integral of the output of the $O_2$-sensor) at the learning is greater than "1". If $\alpha$t0 is greater than "1", the program proceeds to a step 126, where the minimum unit $\Delta A$ (one bit) is added to the learning control coefficient $K_a$ in the corresponding address. If $\alpha$ is less than "1", the program proceeds to a step 127, where it is determined whether $\alpha$ is less than "1". If $\alpha$ is less than "1", the minimum unit $\Delta A$ is subtracted from $K_a$ at a step 128. If $\alpha$ is not less than "1", which means that $\alpha$ is "1", the program exits the updating routine. Thus, the updating operation continues until the value of the $\alpha$ becomes "1".

Figure 5A:
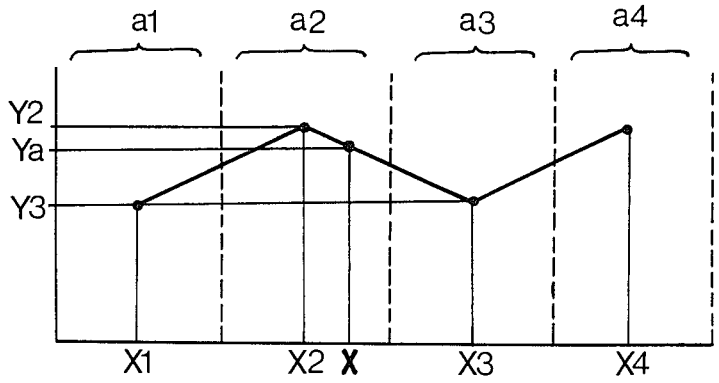
FIG. 5*a* and 5*b* show a linear interpolation for reading the table of FIG. 3*b;*
Figure 5B:
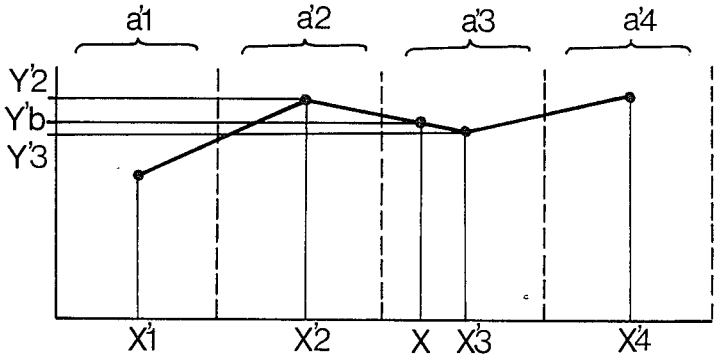

When the injection pulse width ($T_i$) is calculated, the learning control coefficients $K_a$ are read out from the $K_a$-tables $K_1$ and $K_2$ in accordance with the value of engine load L. However, values of $K_a$ are stored at intervals of loads. FIGS. 5*a* and 5*b* show interpolations of contents of $K_a$-table. For example, in $K_a$-table $K_1$, at engine loads $X_1$, $X_2$, $X_3$, and $X_4$, updated values $Y_2$ and $Y_3$ (as coefficient $K_a$) are stored. When the detected engine load does not coincide with the set loads $X_1$ to $X_4$, the coefficient $K_a$ is obtained by linear interpolation. For example, the value $Y_a$ of $K_a$ at engine load X is obtained by the following formula.

$$Y_a=((X-X_2)/(X_3-X_2))\times(Y_3-Y_2)+Y_2$$

Value $Y'_b$ in $K_a$-table $K_2$ is obtained in the same manner. Available coefficient $K_a$ for calculating the fuel injection pulse width is an arithmetical average A of the values $Y_a$ and $Y'_b$.

FIG. 6*a* is a matrix pattern showing the updating probability over 50% and FIG. 6*b* is a pattern showing the probability over 70% by hatching divisions in the matrix. More particularly, in the hatched range in FIG. 6*b*, the updating occurs at a probability over 70%. From the figures, it will be seen that the updating probability at an extreme engine operating steady state, such as the state at low engine load at high engine speed and at high engine load at low engine speed, is very small. In addition, it is experienced that the difference between values of coefficient $K_a$ in adjacent speed ranges is small. Accordingly, it will be understood that the two-dimensional table, in which a single datum is stored at each address, is sufficient for performing the learning control of an engine.

If engine load fluctuates between adjacent divisions over a vertical border line (for example, line $L_{11}$ of matrix $M_1$ of FIG. 3*a*) within one of the engine speed ranges (for example, $N_1$–$N_2$), the steady state can not be detected in the matrix $M_1$. However, in the system of the present invention, the steady state can be detected in the division $D_2$ in the matrix $M_2$. Thus, the updating is performed without delay, reducing the frequency of the learning.

Accordingly, fuel consumption and driveability are improved. Further, since data are read out from two tables and available data is calculated from both data, more reliable data can be obtained.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In a system for controlling an automative engine dependent on updated data, the improvement comprising:

control menas for determining that engine operation is in steady state by determining whether two variables of detected engine operation stay in one division of at least one of first and second matrixes for a predetermined period, said control means comprising a memory storing informatin defining said first and second matrixes, each of the divisions of the matrixes being formed by ranges of the two variables of engine operation, the divisions of the first and seocnd matrixes being staggered on at least one of X and Y axes by a predetermined value, said X and Y axes representing said two variables respectively;

said control means for providing new data for updating in accordance with engine operating conditions when the steady state is determined by said control means;

said control means further comprising a memory having data stored therein in the form of first and second lookup tables, each of said lookup tables having addresses dependent on one of the two variables;

said contol means for updating the data stored in the first and second lookup tables with the new data when the steady state is determined by said control means, whereby the engine is controlled dependent on the updated data.

2. The system according to claim 1, wherein each of said first and second lookup tables is a two-dimensional table.

3. The system according to claim 1, wherein the two variables of engine operation are engine load and engine speed, the engine load is set on the X axis, and the matrixes are staggered on the X axis.

4. The system according to claim 3, wherein each said lookup table has addresses dependent on the engine load.

5. The system according to claim 1, wherein said control means is a computer.

6. The system according to claim 1, wherein said control means is a microprocessor.

7. A system for updating data used in a control system for controlling an automotive engine, comprising control means comprising a memory storing information defining two matrixes each having divisions of ranges of two variables of engine operation, said divisions of said two matrixes being offset with respect to each other by offsetting of the ranges of at least one of said two variables, said control means further for detecting if engine operation is in a steady state by determining if actual detected of said two variables remain in a single division of at least one of said two matrixes for a predetermined time, said control means further comprising a memory having data stored therein in the form of two tables of the data used in the control system for controlling the engine, said two tables being divided into table divisions corresponding to the divisions of said two matrixes of one of said two variables, and said control means further for updating data in said tables when said steady state is detected by said first means.

8. The system according to claim 7, wherein said control means updates the data in said tables in the table division corresponding to said single division of at least one of said two matrixes in which said two variables remain in said steady state.

9. The system according to claim 7, further comprising an $O_2$-sensor means for detecting oxygen content of exhaust gases of the engine and producing an output dependent on said oxygen content for controlling the engine, and said control means updates said data in said tables by a positive and negative increment respectively depending on a value of an integral of said output of the $O_2$-sensor greater and lower respectively than a predetermined value.

10. The system according to claim 7, further comprising means for controlling said engine by the data present in table divisions of said two tables corresponding to a detected value of the variable defining the table divisions of said tables.

11. The system according to claim 7, wherein said control means is a computer.

12. The system according to claim 7, wherein said control means is a microprocessor.

13. A method for controlling an automotive engine in an engine control system dependent on updated data, comprising the steps of:

determining that engine operation is in steady state by determining whether two variables of detected engine operation stay in one division of at least one of first and second matrixes for a predetermined period, each of the divisions of the matrixes being formed by ranges of the two variables of engine operation, the divisions of the first and second matrixes being staggered on at least one of X and Y axes by a predetermined value, said X and Y axes representing said two variables respectively;

storing data in first and second lookup tables, each of said lookup tables having addresses dependent on one of the two variables;

providing new data for updating in accordance with engine operating conditions when the steady state is determined;

updating the data stored in the first and second lookup tables with the new data when the steady state is determined, whereby the engine is controlled dependent on the updated data.

14. A method for updating data used in a control system for controlling an automotive engine, comprising the steps of defining two matrixes each having divisions of ranges of two variables of engine operation, said divisions of said two matrixes being offset with respect to each other by offsetting of the ranges of at least one of said two variables, detecting if engine operation is in a steady state by detemining if actual detected of said two variables remain in a single division of at least one of said two matrixes for a predetermined time, defining two tables of the data used in the control system for controlling the engine, said two tables being divided into table divisions corresponding to the divisions of said two matrixes of one of said two variables, and updating data in said tables when said steady state is detected.

* * * * *